United States Patent [19]

Mencke et al.

[11] Patent Number: 4,590,876

[45] Date of Patent: May 27, 1986

[54] EDGE GUIDE AND FABRIC FEED FOR SEWING MACHINE

[75] Inventors: Helmut Mencke, Schulzendorf; Hans-Jürgen Grüner, Zeuthen; Peter Oertmann, Schulzendorf; Horst Nerlich, Schulzendorf; Heinz Grabasch, Schulzendorf, all of German Democratic Rep.

[73] Assignee: VEB Kombinat Oberbekleidung Berlin Stammbetrieb VEB Herrenbekleidung Fortschritt, Berlin, German Democratic Rep.

[21] Appl. No.: 684,010

[22] Filed: Dec. 20, 1984

[30] Foreign Application Priority Data

Dec. 21, 1983 [DD] German Democratic Rep. ..... 2583536

May 21, 1984 [DD] German Democratic Rep. ..... 2632111

[51] Int. Cl.[4] ..... D05B 35/10

[52] U.S. Cl. ..... 112/262.3; 112/153; 112/306; 112/DIG. 2

[58] Field of Search ..... 112/153, 152, 136, 147, 112/141, 306, DIG. 2, DIG. 3, 262.3, 262.1, 2

[56] References Cited

U.S. PATENT DOCUMENTS

| | | | |
|---|---|---|---|
| 4,186,674 | 2/1980 | Connor, Jr. | 112/153 |
| 4,315,471 | 2/1982 | Torre et al. | 112/153 |
| 4,498,407 | 2/1985 | Landwehr et al. | 112/DIG. 2 |

FOREIGN PATENT DOCUMENTS

| | | |
|---|---|---|
| 2758262 | 7/1979 | Fed. Rep. of Germany . |
| 2839399 | 3/1980 | Fed. Rep. of Germany . |

*Primary Examiner*—H. Hampton Hunter

*Attorney, Agent, or Firm*—Karl F. Ross; Herbert Dubno

[57] ABSTRACT

A pair of superposed flexible web workpieces lying on a horizontal table are fed in a horizontal transport direction to a treatment location downstream of an edge guide having vertically spaced upper, lower, and middle blades defining upper and lower horizontally open slots by continuously horizontally reciprocating the table with a stroke sufficiently long relative to the surface structure of the lower face of the underlying workpiece and at a frequency sufficiently high relative to the inertia of the workpieces that the workpieces will move horizontally relative to the table without substantial friction. An edge of each of the workpieces is engaged in a respective one of the slots and jets of gas are directed from the plates at an angle against the workpieces to hold up the upper and middle plates while urging the workpiece edges into the respective slots substantially out of contact with the plates.

20 Claims, 7 Drawing Figures

EDGE GUIDE AND FABRIC FEED FOR SEWING MACHINE

FIELD OF THE INVENTION

The present invention relates to a sewing machine or similar apparatus that works on the edges of two web workpieces. More particularly this invention concerns a feed apparatus for aligning the edges of two workpieces and feeding them to a treatment station such as a sewing machine.

BACKGROUND OF THE INVENTION

A sewing machine for seaming together edges of web fabric workpieces normally has a large feed table surrounding the machine sewing head and serving to support the goods in front of, behind, and to the side of the sewing head relative to the travel direction of the goods through the head. In addition there is immediately upstream of the sewing head an edge guide comprised of three plates forming two laterally open superposed slots. The workpieces are superposed and the edges of the upper and lower workpieces are fitted respectively to the upper and lower slots and the operator guides the two workpieces through the slots to the sewing head aligned in the travel direction behind them.

This style of operation has many problems. The slot width must be carefully adjusted if the plates are fixed to prevent the workpieces from folding over at the edges, or the spring force must be perfectly set if the plates are biased together to prevent the goods from snagging.

In an advanced system such as described in West German Pat. Nos. 2,758,262 and 2,839,399, the upper and lower plates have angled nozzles from which air jets are emitted to press the workpieces against the upper and lower faces of the middle plate. Even in this arrangement the guide presents considerable drag to the workpieces so that feeding to the sewing station is a laborious and relatively slow process which can scarcely be tolerated in the effeciency-conscious garment industry. Furthermore, thick goods are subjected to greater lateral force than thin goods, so that feed problems are in part a function of the thickness of the fabric being guided and worked on. Finally in such a system the horizontal component of force exerted on the workpieces to hold them in the guide slots is small compared to the friction force against the table, so that these angled jets serve more a purpose of holding the workpiece edges on the middle plate than urging these edges horizontally all the way into the respective guide slots.

In addition the feed table itself poses quite some drag to the goods as the large contact area between it and the lower face of the lower workpiece has considerable static friction, since the workpieces are not displaced rapidly enough to overcome static friction. Attempts to provide air cushions to float the workpieces have proven unworkable due to the low mass/area ratio of the workpieces. Vibrating-table arrangements such as used in bulk particulate conveyors have also been found unworkable as the surface texture of many fabric workpieces is sufficient that this structure can flex to follow the microscopic reciprocations of the table, thereby rendering the system completely nonfunctional.

OBJECTS OF THE INVENTION

It is therefore an object of the present invention to provide an improved method of and apparatus for feeding fabric workpieces to a treatment station such as the stitching head of a sewing machine.

Another object is the provision of such a method of and apparatus for feeding fabric workpieces which overcome the above-given disadvantages, that is which allow the workpieces to be accurately and rapidly fed to the treatment station without substantial drag on the table or at the edge guide.

SUMMARY OF THE INVENTION

A pair of superposed flexible web workpieces lying on a horizontal table are fed in a horizontal transport direction to a treatment location downstream of an edge guide having vertically spaced upper, lower, and middle blades defining upper and lower horizontally open slots according to the invention by continuously horizontally reciprocating the table with a stroke sufficiently long relative to the surface structure of the lower face of the underlying workpiece and at a frequency sufficiently high relative to the inertia of the workpieces that the workpieces will move horizontally relative to the table without substantial friction. An edge of each of the workpieces is engaged in a respective one of the slots and jets of gas are directed from the plates at an angle against the workpieces to hold up the upper and middle plates while urging the workpiece edges into the respective slots substantially out of contact with the plates.

Thus according to this invention the stroke, that is the length of the horizontal displacement of the table in each reciprocation, is made long enough that the surface structure of the lower face of the lower workpiece cannot deform enough to follow it. Thus for fuzzy workpieces this stroke is adjusted to be fairly long. The reciprocation rate or frequency is determined by the mass of the workpieces, so that the table will be reciprocated very rapidly for very light workpieces and less rapidly for heavier ones with greater inertia.

All three of the plates of the edge guide are provided with angled nozzles and the upper two plates are freely vertically displaceable. Thus the jets of air will on the one hand flatten out the respective workpiece edges and urge them into the respective slots while on the other hand they will center the workpiece edges in the slots out of contact with the plates and will hold up the middle and lower plates. This air-cushion support for the middle and upper plates ensures that the system will automatically adjust for workpiece thickness, preserving the same distance between each workpiece face and the confronting face of the respective edge-guide plate.

Setup with this system is relatively simple. The workpieces are laid on the table and the stroke is set to the greatest possible length and the reciprocation rate is similarly set to the fastest possible frequency so that the workpieces will float on the table. Then the reciprocation stroke is decreased until the workpiece starts to move with the table, and is increased a bit to be just long enough to eliminate this joint movement. Similarly the reciprocation rate is decreased until the workpiece starts to move with the table, and then is increased a bit. The lowest practical reciprocation stroke and rate are used that still are sufficient to eliminate static friction and prevent the workpiece from following the table movement.

According to this invention the the table is reciprocated horizontally in one direction and uniformly. It is also possible for it to be reciprocated nonuniformly. This can be done with a phase shift, typically using the characteristic frequency of the spring-supported table as a base of the reciprocation frequency. The variations in reciprocation are dependent on the relationships of amplitude, phase, and frequency and are related to the characteristic frequency of the sprung table.

With the system of this invention the static friction is eliminated uniformly over the entire upper surface of the table, but the sliding friction is only reduced in one direction, that in which the table is reciprocated. Once the system is working, the resistance to sliding of the workpieces is not related to their normal coefficients of friction.

According to this invention the upper and middle plates are vertically displaceable relative to the lower plate. These upper plate is held up on the middle plate by means of an air cushion produced by the jets of the lower slot and the upper plate is held up on the middle plate by means of an air cushion produced by the jets of the upper slot.

The apparatus according to this invention has a horizontal table supporting the workpiece and oriented in a workpiece travel direction upstream therefrom, an edge guide downstream from the treatment location and having vertically spaced upper, lower, and middle plates defining upper and lower horizontally open slots receiving the edges of the upper and lower workpieces. The upper and middle plates are limitedly vertically displaceable relative to the lower plate and each other and are provided with angled nozzles opening inward into the respective slots. Supports carry the table and permit same to move limitedly horizontally. A drive continuously horizontally reciprocates the table with a stroke sufficiently long relative to the surface structure of the lower face of the underlying workpiece and at a frequency sufficiently high relative to the inertia of the workpieces that the workpieces will move horizontally relative to the table without substantial friction. Gas is supplied to the nozzles and is projected therefrom against the workpieces to hold up the upper and middle plates while urging the workpiece edges into the respective slots substantially out of contact with the plates.

The table supports can be trapezoidal or rectangular spring legs. Thus the table is substantially vertically nondisplaceable, but will have a characteristic frequency at which it will naturally tend to reciprocate if set in motion in a direction perpendicular to the planes of the legs.

It is also possible to support the table on an air cushion held in a flexible annular membrane connected to the periphery of the table and to the floor or a base plate underneath the table. Tension or compression springs can braced against two sides of the table to restrain its movement somewhat.

According to another feature of this invention the table is supported on an elastomeric mass that can stand on a fixed substrate and wholly fill the space between the table and the substrate. The table thus constitutes a thin but stiff cover for this mass. The table and the mass can be unitarily formed, sandwich-fashion, typically of Polyurethane or surface-skin polystyrol foam. When the table is of several different parts—for instance one large one upstream of the treatment location, one small one to the side of this location, and another small one behind it—the masses of the parts are made equal for smooth table movement, typically by affixing weights to the lighter portions.

In accordance with another feature of this invention the table is provided with a frequency-measuring system whose output is connected to the electromagnetic actuator for this table.

The nozzles of the middle plate of this invention are upwardly and downwardly directed, the nozzles of the upper plate are downwardly directed, and the nozzles of the lower plate are upwardly directed. This ensures that the slot heights will be automatically self-adjusting.

An actuator of this invention is engageable with the upper and middle plates for raising same and opening the slots. In addition a stationary upright guide column is fixed relative to the lower plate, a middle guide sleeve vertically slidable on the column is fixed to the middle plate, and an upper guide sleeve vertically slidable on the middle sleeve is fixed to the upper plate.

The middle plate is lighter than the upper plate and is coupled to a weight making up the weight difference, although it is also possible for the middle plate to be of greater density to compensate for its smaller size. The weight can be another plate attached to the top end of the middle sleeve above the slot.

The column according to this invention has an upper end provided with a column stop and the middle sleeve has an upper end engageable therewith and carrying a middle stop and the upper sleeve has an upper end engageable with the middle stop. In addition when the upper end of the upper sleeve bears upward against the column stop and the upper end of the middle sleeve bears upward against the middle stop the upper and lower slots both have a predetermined maximum height.

The upper plate can have a beveled lower edge, the lower plate a beveled upper edge, and the middle plate beveled lower and upper edges. These beveled edges are formed with vertically directed nozzles to which a gas under pressure is fed from the supply means. In addition the supply means includes valve means for regulating the flow of gas to the nozzles of the beveled edges and the plates are formed with flow passages connected to the respective nozzles.

DESCRIPTION OF THE DRAWING

The above and other features and advantages will become more readily apparent from the following, reference being made to the accompanying drawing in which.

SPECIFIC DESCRIPTION

Figure 1:
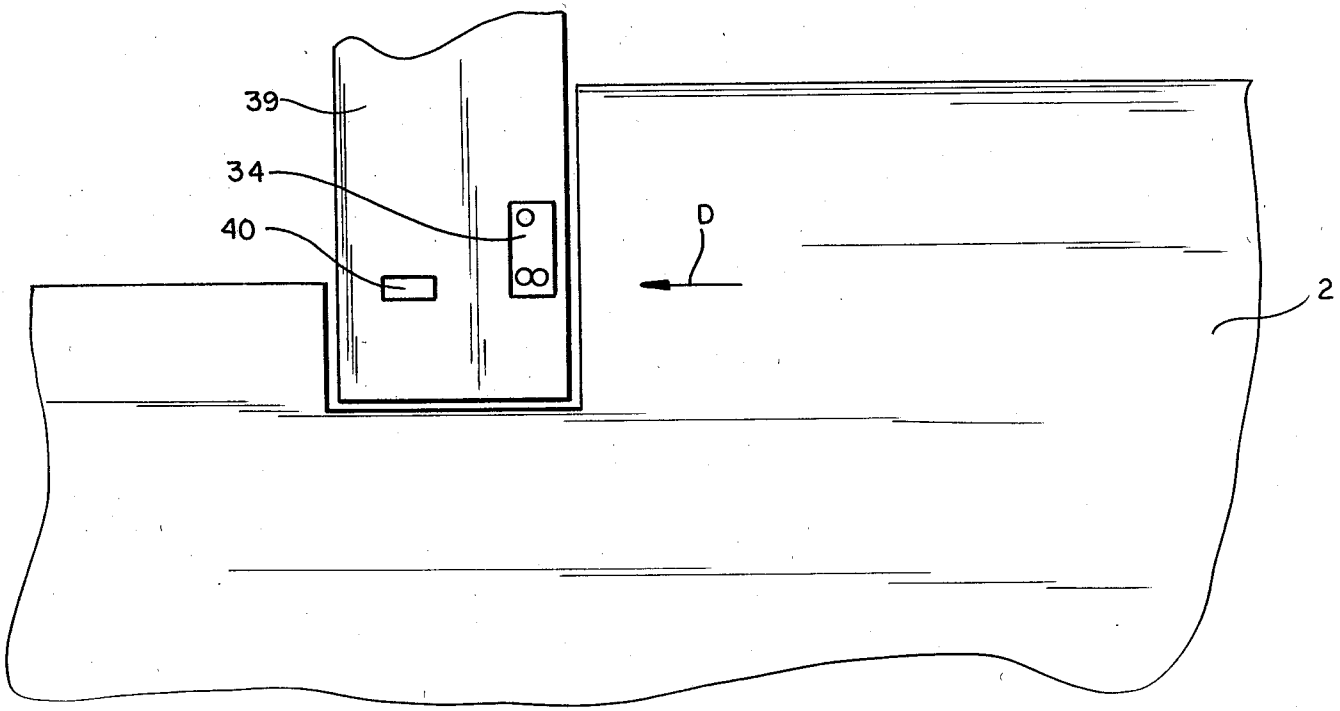
FIG. 1 is a small-scale and partly diagrammatic top view of the apparatus of the present invention.

As seen in FIG. 1 a sewing apparatus according to this invention has a large horizontal feed table 2 on which a workpiece 1 (FIG. 3) normally constituted by a pair of superposed textile webs 1' (FIG. 5) is displaced in a transport direction D past an edge guide 34 of a sewing machine 39 having a sewing location 40 positioned downstream in the direction D from the guide 34.

Figure 2:
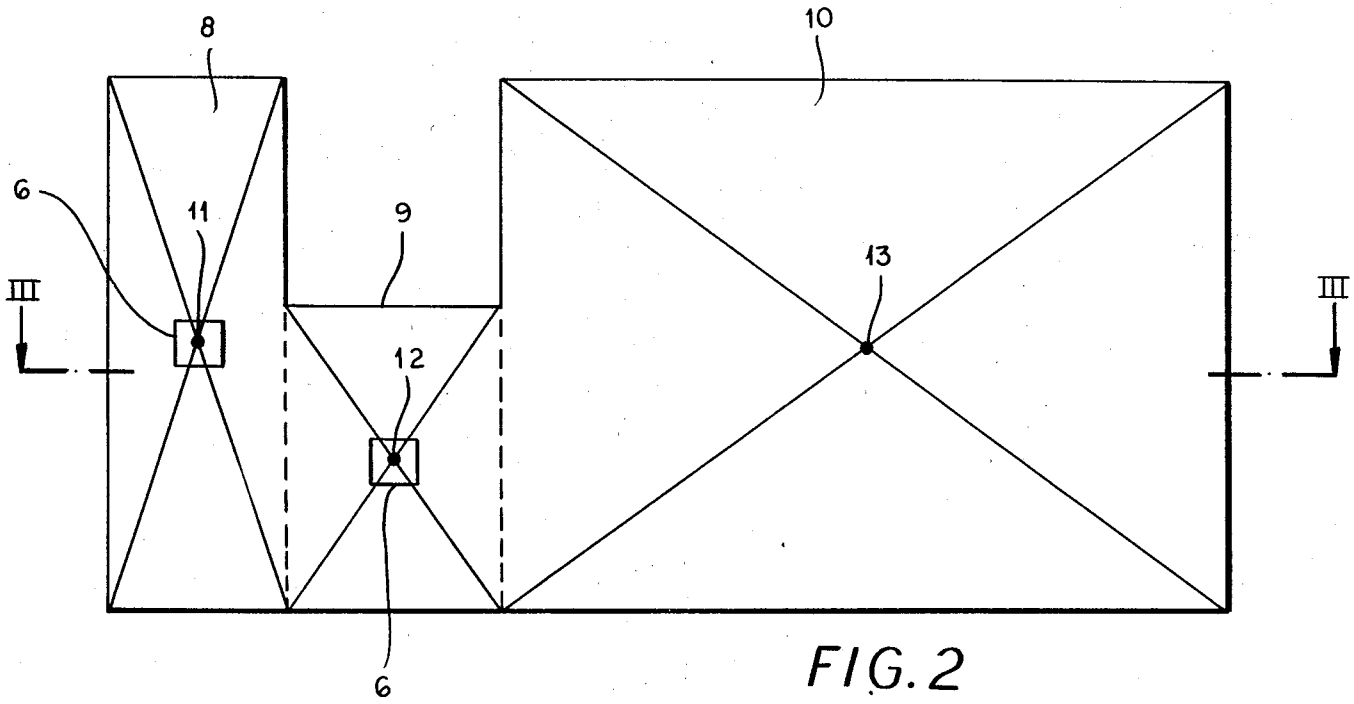
FIG. 2 is a larger-scale top view of the feed table of this invention.
Figure 3:
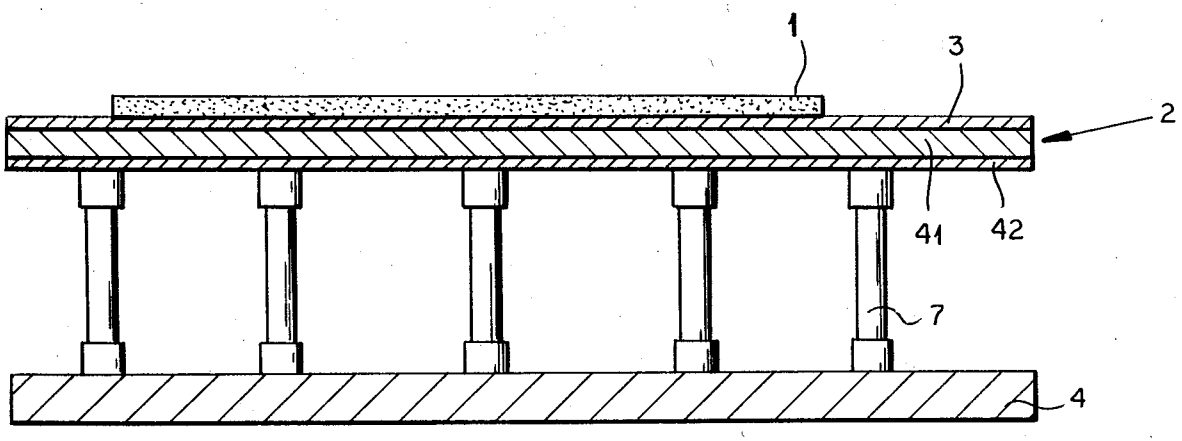
FIG. 3 is a section taken along line III—III of FIG. 2.
Figure 4:
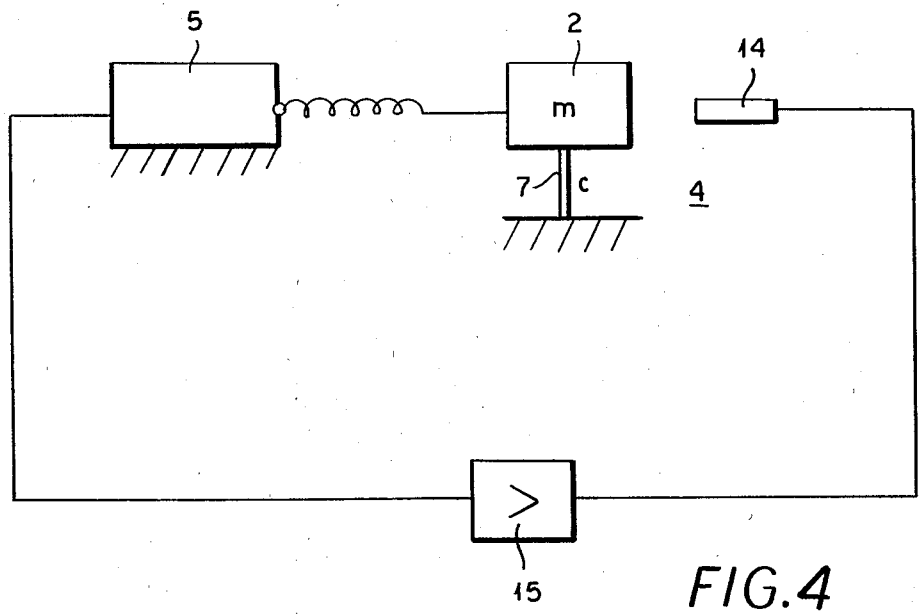
FIG. 4 is a diagrammatic view illustrating the operation of the system of this invention.

The table 2 as shown in FIGS. 2, 3, and 4 comprises a smooth upper layer or surface 3 carried on a soft spongy middle layer 41 carried in turn on a stiff and hard lower surface 42. Flexible spring-steel legs 7 support the table 2 on a fixed base 4 so that the table 2 can move limitedly horizontally relative to the base 4. This movement is effected by an adjustable-stroke solenoid arrangement 5 connected as shown in FIG. 4 to the table 2 and connected via a feedback arrangement 15 to a motion sensor 14 so as to reciprocate the table 2 horizontally transverse to the direction D. The amplitude of the vibration is substantially greater than the surface depth of the goods 1, so that the stroke of the table 2 will be greater than that distance through which the table 1 could move without moving relative to the goods 1, a stroke which can be considerable with very fuzzy material. The frequency of the vibration is determined by the inertia or mass/area ratio of the goods and, as mentioned above, is low for relativley dense and heavy goods and high for lighter goods.

In addition as shown in FIG. 2 the table 2 is basically composed of three rectangular parts 8, 9, and 10 having respective centers of gravity at 11, 12, and 13. Since the parts 8 and 9 which respectively fit behind and next to the sewing machine 39 are substantially smaller and lighter than the part 10, weights 6 are mounted at their centers of gravity. Thus the entire table 2 will be able to reciprocate smoothly in one horizontal direction even if the motive force is applied at only one point.

Figure 5:
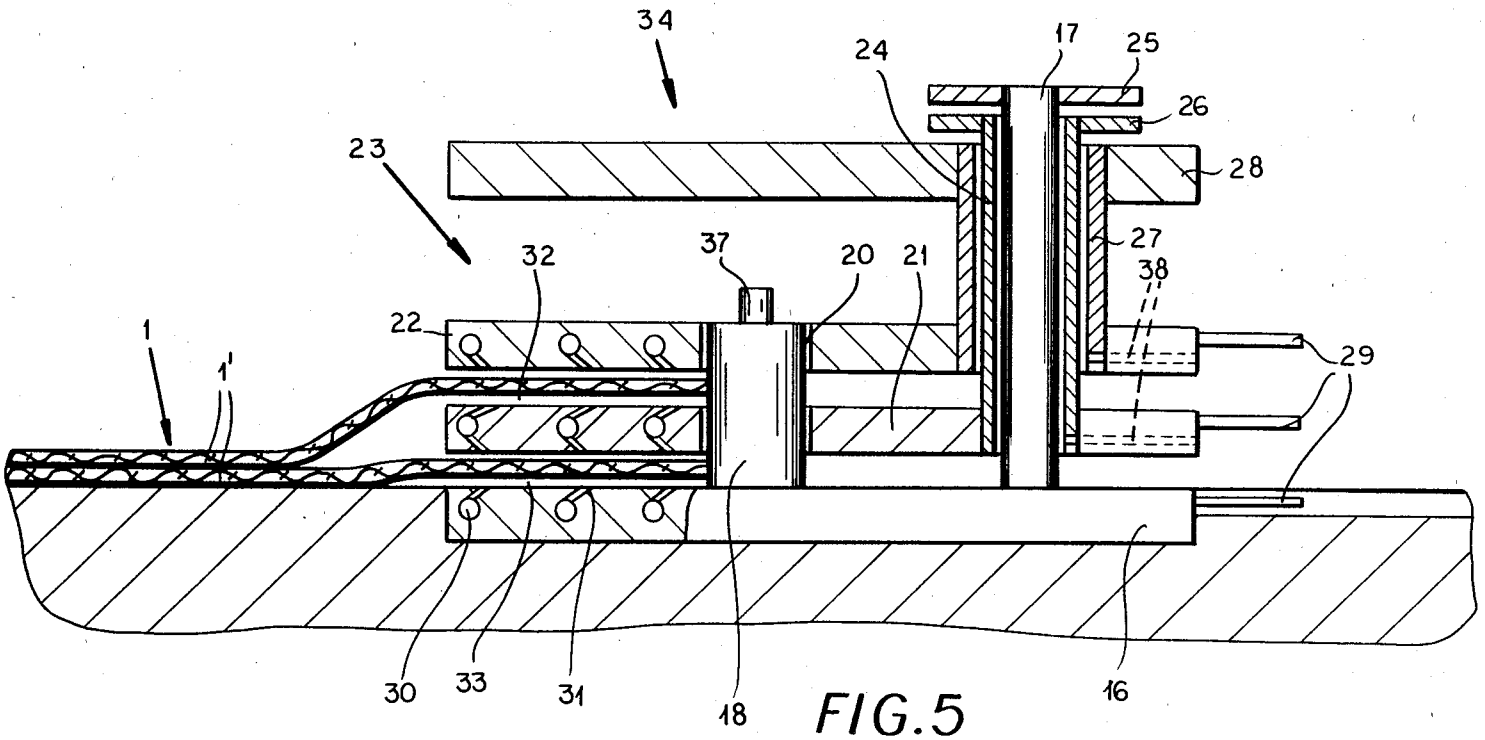
FIG. 5 is a large-scale vertical section through the edge guide according to the invention.
Figure 6:
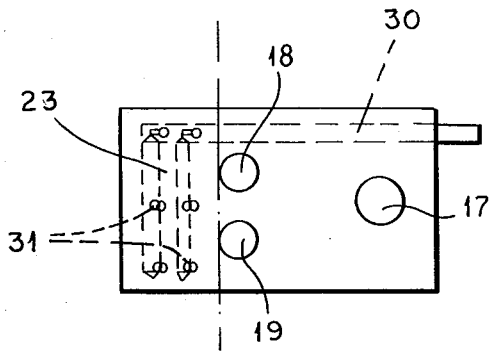
FIG. 6 is a small-scale top view of the edge guide.
Figure 7:
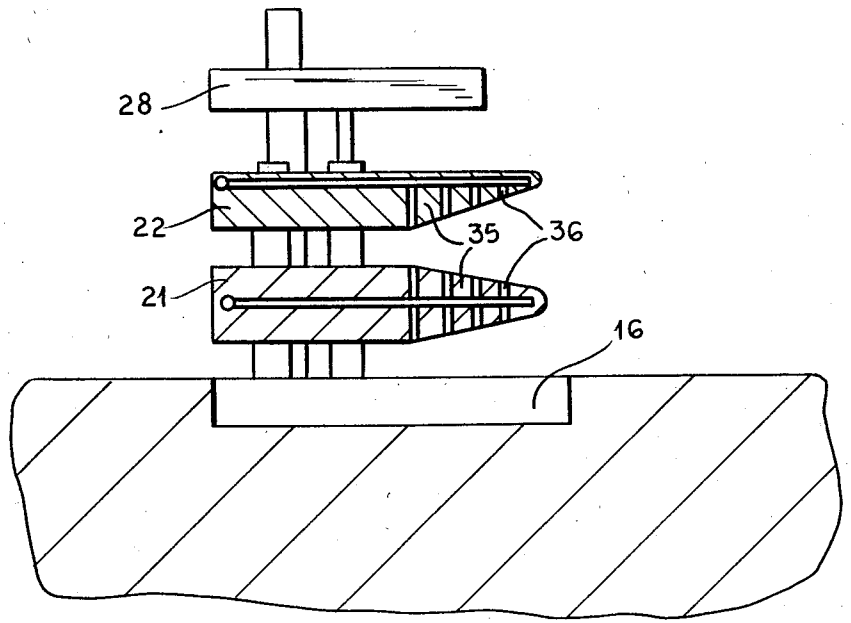
FIG. 7 is a vertical section through a detail of the present invention.

As seen in FIGS. 5 and 6 the edge guide 34 comprises a stationary base plate 16 supporting two stops 18 and 19, the latter being constituted as a cylinder, that are spaced apart in the direction D immediately upstream of the sewing location 40. An intermediate blade or plate 21 and an upper plate 22 are formed with throughgoing cylindrical holes 20 fitting over the stops 18 and 19 so that the three plates 16, 21, and 22 can define a variable-height lower guide slot 33 and a variable-height upper guide slot 32 open perpendicular to the direction from the stops 18 and 19.

A column 17 projecting upward from the plate 16 on the opposite side of the stops 18 and 19 from the slots 32 and 33 passes through the plates 21 and 22 which carry respective inner and outer sleeves 24 and 27 that slide vertically on this column 17. The upper end of the column 17 carries a stop plate 25 and the upper end of the inner sleeve 24 carries a similar such stop plate 26. The upper end of the outer sleeve 27 carries a plate 28 of substantially the same size as the plates 21 and 22, but spaced a fixed distance above the plate 22 to which it is connected by the sleeve 27. The stop 19 has a piston rod 37 that can engage upward against the bottom surface of the plate 28.

The plates 16, 21, and 22 are formed with passages 30 (FIG. 6) that are connected to air-feed lnes 29 and to nozzle holes 22 that are directed into the respective slots 32 and 33 at an acute angle to the horizontal and directed toward the stops 18 and 19. In addition passages 38 connected to the passages 30 open into the sleeves 24 and 27 in the opposite direction to prevent the sleeves 24 and 27 from binding on each other and on the column 17 due to the opposite vector or force created by air exiting from the nozzles 31. These nozzles 31 are spaced apart in and transverse to the direction D and are separated by enough space that the stream exiting from one does not affect that exiting from another.

Upstream of the stops 18 and 19 the plates 21 and 22 can have angled edges 35 formed with vertically opening nozzle holes 36 that can be selectively fed with compressed air to facilitate passing thick parts or seams in the goods 1 into the slots 32 and 33.

The arrangement described above functions as follows:

To start with the cylinder 19 is expanded so that the piston rod 37 pushes up the plate 28, thereby raising the blade 22. When the plate 28 engages the stop 26, the plate 21 will also be lifted, opening the two slots 32 and 33 up to their maximum height. The air feed is then started via the lines 29 and the motor 5 begins rapidly reciprocating the table 2. The goods 1 are then positioned on the table 2, but will virtually float thereon because the reciprocation will completely overcome static friction. The edges of the two pieces 1' are fed into the slots 32 and 33 where they will be urged transversely by the jets of gas issuing from the nozzles 31, and will come up against the stops 18 and 19.

Once the workpieces 1' are fitted to the slots 32 and 33 and the air jets from the nozzles 31 are turned on the cylinder 19 is relaxed. This allows the plates 21 and 22 to drop down somewhat. They do not, however, close the slots 32 and 33 because these jets create an air cushion that holds the plates 21 and 22 up. The edges of the workpieces 1' are suspended in the slots 32 and 33, out of contact with the plates 16, 21, and 22.

The combination of the apparent floating of the workpiece 1 on the table 1 caused by reciprocating it and the gentle lateral force created by the jets 31 will ensure easy and perfect guiding of the workpiece 1 through the sewing station 40. There will be no tendency of the workpiece to bunch up or fold and in fact the vibrating table will normally flatten out a workpiece that is not smoothly laid on it in the first place, as the elimination of the static friction will cause the flexible workpiece to gravitationally move into a flat position just like a liquid.

In addition the air-cushion support of the plates 21 and 22 will ensure that the slots 32 and 33 will adjust automatically to changing workpiece thickness. The spacing between each plate face and the confronting workpiece face will remain the same so that the workpieces will in effect be gripped, and the angling of the nozzles will also ensure that these workpieces will be urged laterally against the stops 18 and 19. As a result a very accurate seam can be sewn.

We claim:

1. A method of feeding a pair of superposed flexible web workpieces lying on a horizontal table in a horizontal transport direction to a treatment location downstream of an edge guide having vertically spaced upper, lower, and middle plates defining upper and lower horizontally open slots, the method comprising the steps of:

continuously horizontally reciprocating the table with a stroke sufficiently long relative to the surface structure of the lower face of the underlying workpiece and at a frequency sufficiently high relative to the inertia of the workpieces that the workpieces will move horizontally relative to the table without substantial friction;

engaging an edge of each of the workpieces in a respective one of the slots; and directing jets of gas from the plates at an angle against the workpieces and thereby holding up the upper and middle plates while urging the workpiece edges into the respective slots substantially out of contact with the plates.

2. The feeding method defined in claim 1 wherein the table is reciprocated horizontally in one direction and uniformly.

3. The feeding method defined in claim 1 wherein the table is reciprocated nonuniformly.

4. The feeding method defined in claim 1 wherein the reciprocation frequency is phase-shifted.

5. The feeding method defined in claim 1 wherein the table is supported on springs to have a characteristic frequency and the table is reciprocated at a frequency that is a multiple thereof.

6. The feeding method defined in claim 2, further comprising the steps of:

vertically displaceably supporting the upper and middle plates; and holding up the middle plate on the lower plate by means of an air cushion produced by the jets of the lower slot and holding up the upper plate on the middle plate by means of an air cushion produced by the jets of the upper slot.

7. An apparatus for feeding a pair of superposed flexible web workpieces to a treatment location, the apparatus comprising:

a horizontal table supporting the workpiece and oriented in a workpiece travel direction upstream therefrom;

an edge guide downstream from the treatment location and having vertically spaced upper, lower, and middle plates defining upper and lower horizontally open slots receiving the edges of the upper and lower workpieces, the upper and middle plates being limitedly vertically displaceable relative to the lower plate and each other and being provided with angled nozzles opening inward into the respective slots;

support means carrying the table and permitting same to move limitedly horizontally;

drive means for continuously horizontally reciprocating the table with a stroke sufficiently long relative to the surface structure of the lower face of the underlying workpiece and at a frequency sufficiently high relative to the inertia of the workpieces that the workpieces will move horizontally relative to the table without substantial friction; and means for supplying gas to the nozzles and therefrom against the workpieces for holding up the upper and middle plates while urging the workpiece edges into the respective slots substantially out of contact with the plates.

8. The feed apparatus defined in claim 7 wherein the support means is upright spring legs carrying the table.

9. The feeding method defined in claim 7 wherein the support means is an air cushion underneath the table.

10. The feed apparatus defined in claim 7 wherein the nozzles of the middle plate are upwardly and downwardly directed, the nozzles of the upper plate are downwardly directed, and the nozzles of the lower plate are upwardly directed.

11. The feed apparatus defined in claim 7, further comprising actuator means engageable with the upper and middle plates for raising same and opening the slots.

12. The feed apparatus defined in claim 7, further comprising:

a stationary upright guide column fixed relative to the lower plate;

a middle guide sleeve vertically slidable on the column and fixed to the middle plate; and an upper guide sleeve vertically slidable on the middle sleeve and fixed to the upper plate.

13. The feed apparatus defined in claim 12 wherein the middle plate is lighter than the upper plate and is coupled to a weight making up the weight difference.

14. The feed apparatus defined in claim 13 wherein the weight is a plate attached to the middle sleeve and above the slots.

15. The feed apparatus defined in claim 12 wherein the column has an upper end provided with a column stop and the middle sleeve has an upper end engageable therewith and carrying a middle stop and the upper sleeve has an upper end engageable with the middle stop.

16. The feed apparatus defined in claim 15 wherein when the upper end of the upper sleeve bears upward against the column stop and the upper end of the middle sleeve bears upward against the middle stop the upper and lower slots both have a predetermined maximum height.

17. The feed apparatus defined in claim 7 wherein the upper plate has a beveled lower edge, the lower plate has a beveled upper edge, and the middle plate has beveled lower and upper edges.

18. The feed apparatus defined in claim 7 wherein the beveled edges are formed with vertically directed nozzles to which a gas under pressure is fed from the supply means.

19. The feed apparatus defined in claim 18 wherein the supply means includes valve means for regulating the flow of gas to the nozzles of the beveled edges.

20. The feed apparatus defined in claim 17 wherein the plates are formed with flow passages connected to the respective nozzles.

* * * * *